US006309242B1

(12) United States Patent
Ohtaka et al.

(10) Patent No.: US 6,309,242 B1
(45) Date of Patent: Oct. 30, 2001

(54) ELECTRICAL CONNECTOR WITH A COUPLING STATE INDICATING MECHANISM

(75) Inventors: Kazuto Ohtaka; Hideki Ohsumi, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/336,746

(22) Filed: Jun. 21, 1999

(30) Foreign Application Priority Data

Jun. 22, 1998 (JP) ..... 10-174766

(51) Int. Cl.[7] ..... H01R 3/00
(52) U.S. Cl. ..... 439/489
(58) Field of Search ..... 439/489, 488, 439/157, 310, 347, 153, 345

(56) References Cited

U.S. PATENT DOCUMENTS 5,605,472 2/1997 Sakai et al. ..... 439/489
5,823,807 * 10/1998 Yamasaki et al. ..... 439/157

FOREIGN PATENT DOCUMENTS 1-165582 11/1989 (JP) .
6-151006 5/1994 (JP) .
9-251875 9/1997 (JP) .

* cited by examiner

*Primary Examiner*—Brian Sircus
*Assistant Examiner*—Brian S. Webb
(74) *Attorney, Agent, or Firm*—Armstrong, Westerman, Hattori, McLeland & Naughton, LLP

(57) ABSTRACT

An electrical connector with a coupling state indicating mechanism is provided, which includes: a first connector having a semicylindrical projection; a second connector having a slider receiving portion and to be coupled with the first connector, the slider receiving portion being provided with a guide groove to guide the projection and with an abutting plane; and a slider to be slidably received in the slider receiving portion for indicating a coupling state of the first and second connectors, the slider having an engaging projection to prevent coming-off thereof, an oblique cam groove to receive the projection therein so as to slide the slider toward the abutting plane, a releasing groove continuing from the cam groove to release the projection from the cam groove when the first and second connectors have completely coupled so as to return the slider to an initial position, and a spring portion to abut on the abutting plane and to be compressively transformed to bring about a force to return the slider, wherein a curved surface of the projection slides on a wall of the cam groove so as to attain smooth sliding and a plane surface of the projection is parallel to the releasing groove so as to surely shift the projection from the cam groove to the releasing groove. Thus, the slider is moved and abuts on the abutting plane in a process of coupling the first and second connectors and then returns to the initial position upon complete coupling thereof.

2 Claims, 7 Drawing Sheets

ELECTRICAL CONNECTOR WITH A COUPLING STATE INDICATING MECHANISM

BACKGROUND OF THE INVENTION

1. Field of the Invention

The present invention generally relates to an electrical connector and more particularly, to an electrical connector having a slider which indicates a coupling state of male and female connectors.

2. Description of the Related Art

Japanese Utility Model Registration Application laid-open No. 1-165582 (hereinafter "JP'582") and Japanese Patent Application Laid-open No. 9-251875 (hereinafter "JP'875") disclose an electrical connector having a slider as a coupling state checking means on a male or female connector.

FIGS. 4, 5A, 5B, and 5C show a prior art electrical connector disclosed in JP'582.

FIG. 4 is a perspective view showing a first prior art electrical connector consisting of male and female connectors. And, FIGS. 5A–5C are partly sectional side views showing movement of a slider of the electrical connector of FIG. 4.

In FIG. 4, the prior art electrical connector 100 consists of a male connector 110, a slider 120 provided on the male connector 110 as a coupling state checking means, and a female connector 130 to be coupled to the male connector 110.

A housing 111 of the male connector 110 is provided with a resilient locking arm 112 which has a locking nail 112*a* on the rear end thereof.

As is shown in FIGS. 4 and 5A, an engaging projection 113 projects from both sides of a root portion of the locking arm 112. The engaging projections 113 act as a stopper for the slider 120.

The slider 120 is slidably provided on an upper portion of the male connector 110 and has a pair of right and left resilient engaging members 121 being in a spear-shape and extending toward the front end of the male connector 110.

The slider 120 is prevented from sliding forward by an abutment of the front ends of the resilient engaging members 121 against the engaging projections 113 of the male connector 110.

The top wall of the female connector 130 is provided with a lock opening 132 to engage the locking nail 112*a* of the male connector 110.

And, inside the housing 131 of the female connector 130 a pair of spear-shaped engagement releasing members 133 project, which engagement releasing members 133 pass under the respective engaging projections 113 of the male connector 110 and slidingly push upwardly the respective resilient engaging members 121.

Referring to FIG. 5A–5C, a checking action of a coupling state of the male and female connectors 110,130 by means of the slider 120 is described below.

As shown in FIG. 5A, before coupling the male and female connectors 110,130, the slider 120 can not be advanced since the front ends of the resilient engaging members 121 of the slider 120 abut on the engaging projections 113 of the male connector 110.

Next, as shown in FIG. 5B, upon complete coupling of the male and female connectors 110,130, the inclined planes 121*a* of the resilient engaging members 121 of the slider 120 slide on the respective inclined planes 133*a* of the engagement releasing members 133 of the female connector 130 and the resilient engaging members 121 are bent upwardly.

And then, the resilient engaging members 121 are disengaged from the engaging projections 113 and, as shown in FIG. 5C, the slider 120 can be inserted forwardly.

That is, the slider 120 can be inserted forwardly only when the male and female connectors 110,130 are completely coupled.

Therefore, an operator can check a coupling state of the male and female connectors 110,130 according to possibility of the inserting operation.

Further, a second prior art electrical connector disclosed in "JP'875" is described, referring to FIGS. 6 and 7.

FIG. 6 is an exploded perspective view showing a second prior art electrical connector consisting of male and female connectors, and FIG. 7 is a partly sectional plan view showing an initial coupling state of the male and female connectors of FIG. 6.

In FIG. 6, the prior art electrical connector 200 consists of a female connector 210, a slider 220 provided on the female connector 210 as a coupling state checking means, a cover 230 to slidably cover the slider 220, and a male connector 240 to be coupled to the female connector 210.

A housing 211 of the female connector 210 is provided with opposite slide grooves 212 for attaching the slider 220 and the cover 230.

As shown in FIGS. 6 and 7, a number of male terminals project inside the housing 211, wherein reference numerals 213 and 214 indicate a coupling detecting male terminal and a feeding male terminal, respectively.

These the coupling detecting male terminal 213 and the feeding male terminal 214 are connected to the judging circuit 250.

And, a warning lamp 260 to indicate a coupling state of the male and female connectors 240,210 is connected to the judging circuit 250.

The judging circuit 250 puts on the warning lamp 260 when the circuit 250 is fed from the feeding male terminal 214 and simultaneously the coupling detecting male terminals 213 are not shorted. On the contrary, the judging circuit 250 puts off the warning lamp 260 when the circuit 250 is fed from the feeding male terminal 214 and simultaneously the coupling detecting male terminals 213 are shorted.

As shown in FIG. 6, a guide rib 221 to be guided by one slide groove 212 of the female connector 210 is provided on one side of the slider 220, and a guide groove 223 to correspond to the other slide groove 212 is provided on the other side of the slider 220. And, an exposed wall 222 is formed integrally with the guide groove 223.

As shown in FIGS. 6 and 7, a pair, of springs 224 to abut on one end of the cover 230 for pushing the slider 220 toward the other end is provided on one end side of the slider 220.

On the other hand, on the other end side of the slider 220, a forked-shape coupling detecting female terminal 226 to short the coupling detecting male terminals 213 of the female connector 210 is provided.

Further, as shown in FIG. 7, on the back of the slider 220, a slide-driving portion 225 to make the slider 220 slide along the slide grooves 212 is integrally formed, which slide-driving portion 225 is provided with an oblique cam 225*a*.

In FIGS. 6 and 7, a pushing projection 242 projects from the top of a housing 241 of the male connector 240.

The pushing projection 242 comes into contact with the cam 225*a* of the slide-driving portion 225 in a coupling process of the male and female connectors 240,210 and makes the slider 220 slide longitudinally.

And, inside the housing 241 of the male connector 240, a number of female terminals to be connected to the male terminals of the female connector 210 project. A reference numeral 243 indicates a feeding female terminal which is to be connected to the feeding male terminal 214 of the female connector 210 and feeds to the judging circuit 250.

Next, referring to FIG. 7, a checking action of a coupling state of the male and female connectors 240,210 by means of the slider 220 is described.

In FIG. 7, as inserting the male connector 240 into the female connector 210, the pushing projection 242 of the male connector 240 pushes the cam 225*a* of the slide-driving portion 225 and moves the slider 220 back against the springs 224.

This makes the coupling detecting female terminal 226 of the slider 220 get out of contact with the coupling detecting male terminals 213 of the female connector 210.

As further inserting the male connector 240 into the female connector 210, the feeding female terminal 243 of the male connector 240 comes into contact with the feeding male terminal 214 of the female connector 210 and the judging circuit 250 is fed.

By this, the warning lamp 260 is put on, which indicates that the male connector 240 and the female connector 210 are in an incomplete coupling state.

And then, as completely coupling the male connector 240 to the female connector 210, the pushing projection 242 of the male connector 240 passes over the cam 225*a* of the slide-driving portion 225 and the slider 220 returns to the initial state.

And, the coupling detecting female terminal 226 of the slider 220 comes into contact with the coupling detecting male terminals 213 of the female connector 210, and the coupling detecting male terminals 213 short.

This stops feeding to the judging circuit 250 and puts off the warning lamp 260, which indicates that the male connector 240 and the female connector 210 are in a complete coupling state.

Therefore, a complete coupling of the male and female connectors 240,210 can be surely obtained by inserting the male connector 240 into the female connector 210 until the warning lamp 260 is put off, thereby surely preventing occurrence of an incomplete coupling of the male and female connectors 240,210.

With respect to the above first prior art electrical connector 100, however, since a coupling state of the male and female connectors 110,130 is checked according to possibility of an pushing operation of the slider 120 by an operator, if an operator neglects the pushing operation of the slider, a coupling state of the male and female connectors 110,130 can not be checked.

And, besides the necessity of the pushing operation of the slider 120 to check a coupling state of the male and female connectors 110,130, the slider 120 has to be returned to the initial state in preparation for coupling the connectors 110, 130 again after uncoupling the coupled male and female connectors 110,130.

On the other hand, with respect to the above second prior art electrical connector 200, though a coupling state of the male and female connectors 240,210 can be checked without any operation, the slider 220 has to be returned in order to extract the male connector 240 from the female connector 210 in case of uncoupling the male and female connectors 240,210.

And, since the spring 224 as the returning means of the slider 220 and also the judging circuit 250 or the warning lamp 260 as the indication means of the coupling state are used, a number of parts are required and the structure is complicated.

SUMMARY OF THE INVENTION

In view of the foregoing, an object of the present invention is to provide an electrical connector wherein a coupling state of first and second connectors can be easily checked according to a state of a slider without operating the slider and simultaneously large reduction in number of parts and simplification of the structure can be attained.

In order to achieve the above-described object, as a first aspect of the present invention, an electrical connector with a coupling state indicating mechanism includes: a first connector having a semicylindrical projection; a second connector having a slider receiving portion and to be coupled with the first connector, the slider receiving portion being provided with a guide groove to guide the projection and with an abutting plane; and a slider to be slidably received in the slider receiving portion for indicating a coupling state of the first and second connectors, the slider having an engaging projection to prevent coming-off thereof, an oblique cam groove to receive the projection therein so as to slide the slider toward the abutting plane, a releasing groove continuing from the cam groove to release the projection from the cam groove when the first and second connectors have completely coupled so as to return the slider to an initial position, and a spring portion to abut on the abutting plane and to be compressively transformed to bring about a force to return the slider, wherein a curved surface of the projection slides on a wall of the cam groove so as to attain smooth sliding and a plane surface of the projection is parallel to the releasing groove so as to surely shift the projection from the cam groove to the releasing groove.

According to the above-described structure, upon coupling of the first connector and the second connector, the projection of the first connector pushingly engages the cam groove of the slider, which makes the slider slide toward the abutting plane of the slider receiving portion. And, the spring portion of the slider abuts on the abutting plane and is compressively transformed. And then, upon complete coupling of the first connector and the second connector, the projection of the first connector enters the releasing groove of the slider, and the slider returns to the initial state by return of the spring portion.

That is, according to the abovedescribed structure, since the slider slides and the spring portion is compressively transformed only when the first connector is in a coupling process, i.e. in an incomplete coupling state, an operator can look at and check a coupling state of the first and second connectors.

Further, an operator can easily look at and check the coupling state of the first and second connectors only by coupling the connectors without operating the slider at all.

Still further, since the spring as the returning means of the slider and also the judging circuit or the warning lamp as the indication means of the coupling state, which are required in the second prior art electrical connector, are not required, large reduction in number of parts and simplification of the structure can be attained.

As a second aspect of the present invention, in the structure with the above first aspect, the releasing groove of the slider engages the projection when the first and second connectors have completely coupled, whereby the first connector is locked to the second connector.

According to the above-described structure, similarly to the structure with the above first aspect, an operator also can easily look at and check the coupling state of the first and second connectors, and simultaneously loosening and coming off of the first connector completely coupled to the second connector can be prevented.

As a third aspect of the present invention, an electrical connector with a coupling state indicating mechanism includes: a first connector having a rib; a second connector having a slider receiving portion and to be coupled with the first connector, the slider receiving portion being provided with a first abutting plane and a second abutting plane; and a slider to be slidably received in the slider receiving portion for indicating a coupling state of the first and second connectors, the slider having an oblique cam projection to be slidingly pushed by the rib on one side thereof so as to slide the slider toward the first abutting plane and to be slidingly pushed by the rib on another side thereof so as to slide the slider toward the second abutting plane and also having first and second spring portions on respective ends thereof to abut on the first and second abutting planes, respectively, and each to be compressively transformed to bring about a force to return the slider.

According to the above-described structure, in a process of coupling the first connector to the second connector, the rib of the first connector abuts on a first side plane of the cam projection of the slider and makes the slider slide toward the first abutting plane side of the slider receiving portion. This makes the first spring portion of the slider abut on the first abutting plane and compressively transform. Following this, when the first connector has completely coupled to the second connector, the rib of the first connector has passed over the first side plane of the cam projection of the slider. By this, the first spring portion returns and makes the slider return to the initial state. On the other hand, in a process of uncoupling the first connector from the second connector, the rib of the first connector abuts on a second side plane of the cam projection of the slider and makes the slider slide toward the second abutting plane side of the slider receiving portion. This makes the second spring portion of the slider abut on the second abutting plane and compressively transform. Following this, when the first connector has been completely uncoupled from the second connector, the rib of the first connector has passed over the second side plane of the cam projection of the slider. By this, the second spring portion returns and makes the slider return to the initial state.

That is, according to the above-described structure, an operator can look at and easily check a coupling state of the first and second connectors according to a state of the first spring portion being compressively transformed or not, without operating the slider at all. And further, an operator can couple and uncouple the first and second connectors also without operating the slider at all.

As a fourth aspect of the present invention, in the structure with the above first, second, or third aspect, the spring portion of the slider consists of a pair of spring pieces formed in a forked shape.

According to the above-described structure, an operator can easily recognize a coupling state of the male and female connectors according to the apparent change of an outline of the spring pieces of the spring portion, and also the spring pieces can exhibit sufficient resilience to return the slider.

The above and other objects and features of the present invention will become more apparent from the following description taken in conjunction with the accompanying drawings.

DESCRIPTION OF THE PREFERRED EMBODIMENTS

Embodiments of the present invention will now be described in further detail with reference to the accompanying drawings.

A first embodiment of an electrical connector in accordance with the present invention is described first.

Figure 1:
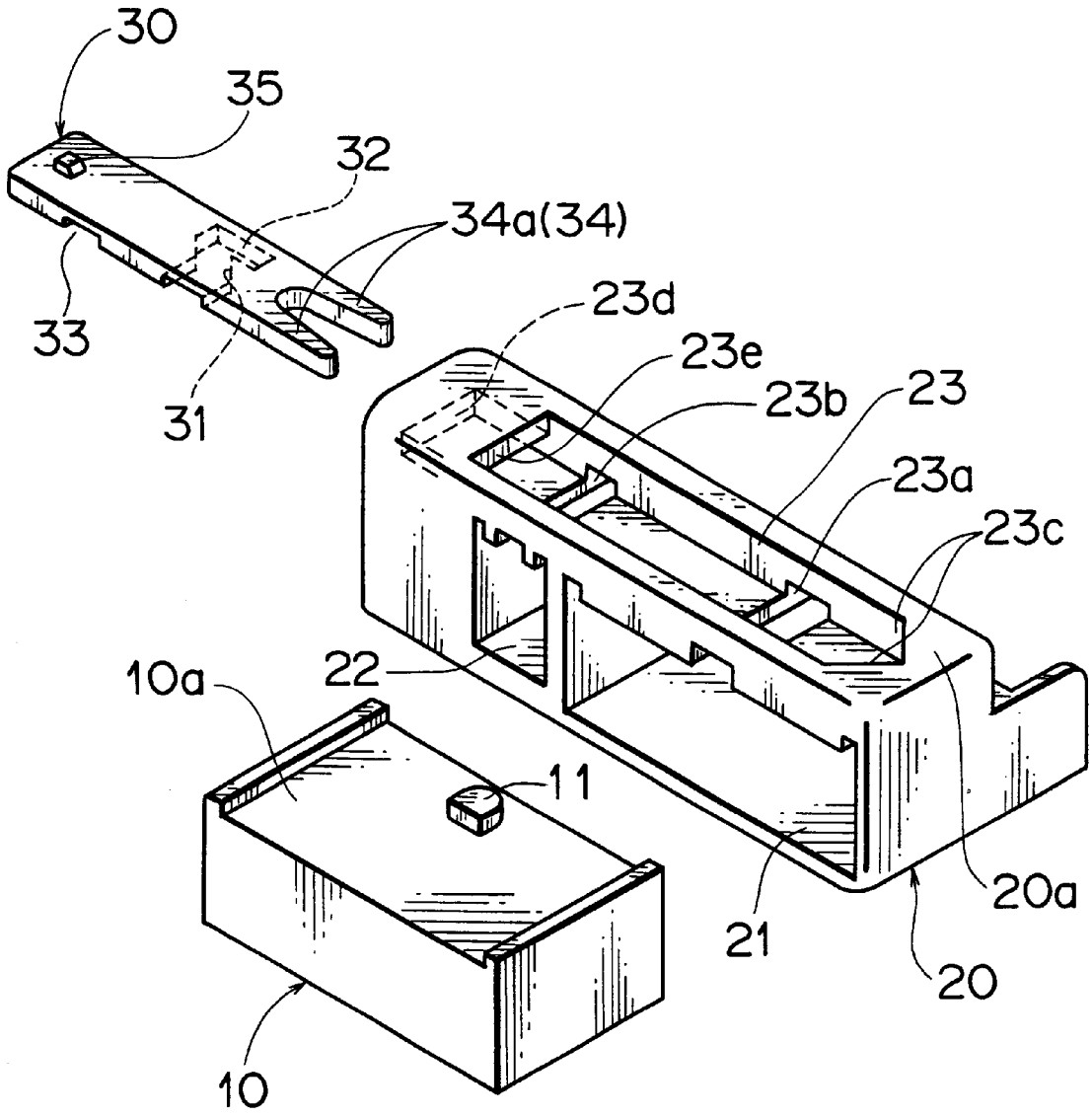
FIG. 1 is an exploded perspective view showing a first embodiment of an electrical connector in accordance with the present invention.
Figure 2A:
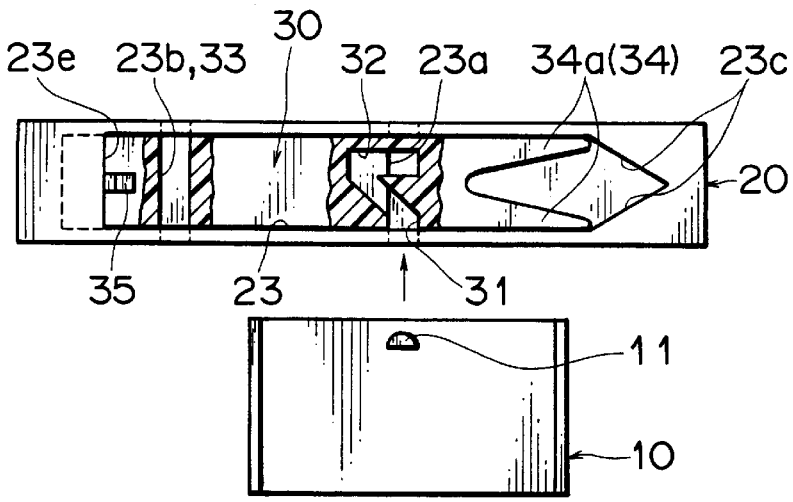
FIGS. 2A–2C are partly sectional plan views showing movement of a slider of the electrical connector of FIG. 1.
Figure 2B:
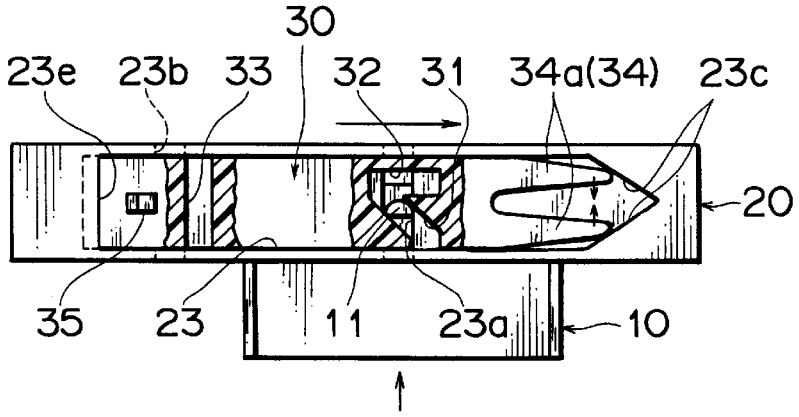
Figure 2C:
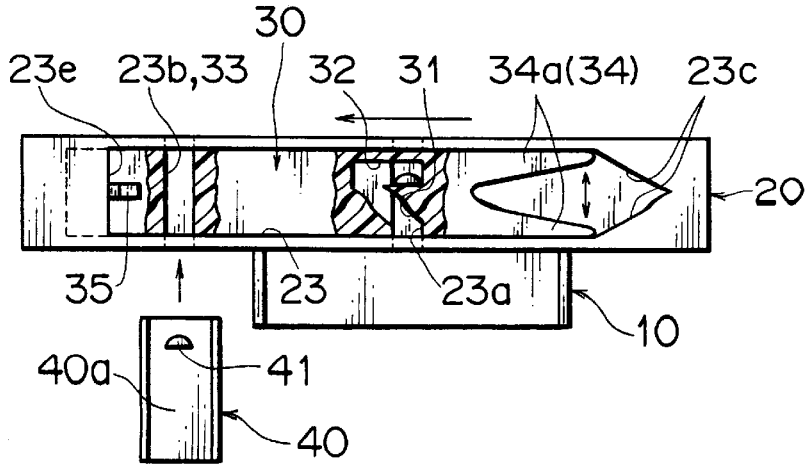

FIG. 1 is an exploded perspective view showing a first embodiment of an electrical connector in accordance with the present invention, and FIGS. 2A–2C are partly sectional plan views showing movement of a slider of the electrical connector of FIG. 1.

As shown in FIG. 1, the electrical connector of the present embodiment consists of a first male connector 10, a female connector 20, a slider 30, and a second male connector 40 (FIG. 2C).

A top wall 10*a* of the first male connector 10 and a top wall 40*a* of the second male connector 40 are provided with respective semicylindrical projections 11,41.

These projections 11,41 each have a curved surface on the front side thereof in order to smoothly enter respective first and second guide grooves 23*a*,23*b* (described later) of the female connector 20 and also to smoothly slide on respective walls of a cam groove 31, a releasing groove 32, and a guide groove 33 (also described later) of the slider 30. The projection 11 has a plane surface, on the rear side thereof, parallel to the releasing groove so as to surely shift the projection from the cam groove to the releasing groove.

The first and second male connectors 10,40 each have a plurality of female terminals (not shown).

The female connector 20 has first and second connector receiving portions 21,22 to. receive the first and second male connectors 10,40 and a plurality of male terminals (not shown) project in each of the first and second connector receiving portions 21,22.

Inside the top wall 20*a* of the female connector 20, a groove-like slider receiving portion 23 which slidably receives the slider 30 is provided.

In the slider receiving portion 23, first and second guide grooves 23*a*,23*b* communicating with the first and second connector receiving portions 21,22, respectively, are formed.

The first and second guide grooves 23*a*,23*b* are straight and then guide the respective projections 11,41 of the first and second male connectors 10,40 straight.

The slider receiving portion 23 has abutting planes 23*c* on one side thereof, which abutting planes 23*c* each are directed to an axis of the slider receiving portion 23.

And, the slider receiving portion 23 has a slider inserting opening 23*d* and an engaging wall 23*e* on the other side thereof, which engaging wall 23*e* engages an engaging projection 35 (described later) of the slider 30, thereby preventing, coming-off of the slider 30.

The slider 30 is made of plate-like synthetic resin similar to the first and second male connectors 10,40 and the female connector 20.

On the back of the slider 30, cam groove 31 and a releasing groove 32 both corresponding to the first guide groove 23*a* and also a guide groove 33 corresponding to the second guide groove 23*b* are formed.

The cam groove 31 is an oblique one, with which the projection 11 engages in a process of coupling the first male connector 10 to the first connector receiving portion 21 of the female connector 20, and the projection 11 shifts the slider 30 to the abutting planes 23*c* side of the connector receiving portion 23.

The releasing groove 32 is a straight one continuing from the end of the card groove 31. The releasing groove 32 returns the slider 30 into the initial state by releasing the projection 11 from the cam groove 31 when the first male connector 10 has been completely coupled to the first connector receiving portion 21 of the female connector 20.

This releasing groove 32 holds the projection 11 when the first male connector 10 has been completely coupled to the first connector receiving portion 21.

The guide groove 33 is also a straight one with the same width as of the second guide groove 23*b*. The guide groove 33 lies just on the second guide groove 23*b* when the slider 30 is in the initial state and guides straight the projection 41 of the second male connector 40 which is coupled to the second connector receiving portion 22 of the female connector 20.

On one side of the slider 30 a spring portion 34 is integrally formed, which spring portion 34 is compressively transformed upon abutment against the abutting planes 23*c* of the slider receiving portion 23 when the slider 30 is shifted in a process of coupling the first male connector 10 to the first connector receiving portion 21 of the female connector 20.

The spring portion 34 consists of a pair of spring pieces 34*a*, 34*a* and changes from an open state to a closed state as being compressively transformed along the abutting planes 23*c*.

The slider 30 is received from the slider inserting opening 23*d* of the female connector 20 into the slider receiving portion 23. On the other side of the slider 30, the engaging projection 35 projects for engaging the slider 30 with the slider receiving portion 23. The engaging projection 35 abuts against the engaging wall 23*e* of the slider receiving portion 23 in order to prevent the slider 30 from coming out.

Next, movement of the slider 30 is described, referring to FIGS. 2A–2C.

FIG. 2A shows a state before coupling of the first and second male connectors 10,40 and the female connector 20.

In this state, the slider 30 is in the initial state wherein the spring portion 34 is not compressively transformed at all.

In such a initial state of the slider 30, the start point of the cam groove 31 corresponds to the first guide groove 23*a* of the slider receiving portion 23, and the guide groove 33 corresponds to the second guide groove 23*b* of the slider receiving portion 23.

Following to the above, as shown in FIG. 2B, upon coupling of the first male connector 10 and the first connector receiving portion 21 (FIG. 1) of the female connector 20 the projection 11 of the first male connector 10 pushingly engages the cam groove 31 of the slider 30, which makes the slider 30 slide toward the abutting. planes 23*c* of the slider receiving portion 23.

And, the spring portion 34 of the slider 30 abuts on the abutting planes 23*c* and is compressively transformed, and the spring pieces 34*a* thereof close.

Further, as shown in FIG. 2C, upon complete coupling of the first male, connector 10 and the first connector receiving portion 21 of the female connector 20, the projection 11 of the first male connector 10 enters the releasing groove 32 of the slider 30, and the slider 30 returns to the initial state by return of the spring portion 34.

Like this, the releasing groove 32 of the slider 30 engages the projection 11 of the first male connector 10, thereby preventing the first male connector 10, which is completely coupled to the first connector receiving portion 21, from being loosened and coming off.

And, the guide groove 33 of the slider 30 corresponds to the second guide groove 23*b* of the slider receiving portion 23, which ensures the second male connector 40 to couple to the second connector receiving portion 22 (FIG. 1) of the female connector 20.

According to the present embodiment of an electrical connector, since the slider 30 slides and the spring portion 34 is compressively transformed only when the first male connector 10 is in a coupling process, i.e. in an incomplete coupling state, an operator can look at and check a coupling state of the first male connector 10 and the female connector 20 according to a state of the spring portion 34 being compressively transformed or not.

And, since the spring pieces 34*a* of the slider 30 are in the open state when the first male connector 10 is in a complete coupling state and the spring pieces 34*a* of the slider 30 are in the closed state when the first male connector 10 is in the incomplete coupling state, the coupling state can be easily recognized according to the apparent change of an outline of the spring pieces 34*a*.

Further, an operator can easily look at and check the coupling state of the first male connector 10 and the female connector 20 only by coupling the connectors 10,20, without operating the slider 30 at all.

Still further, compared to the second prior art electrical connector, large reduction in number of parts and simplification of the structure can be attained.

Hereinafter, a second embodiment of an electrical connector in accordance with the present invention is described.

FIGS. 3A–3D are partial perspective views showing movement of a slider of a second embodiment of an electrical connector in accordance with the present invention.

Figure 3A:
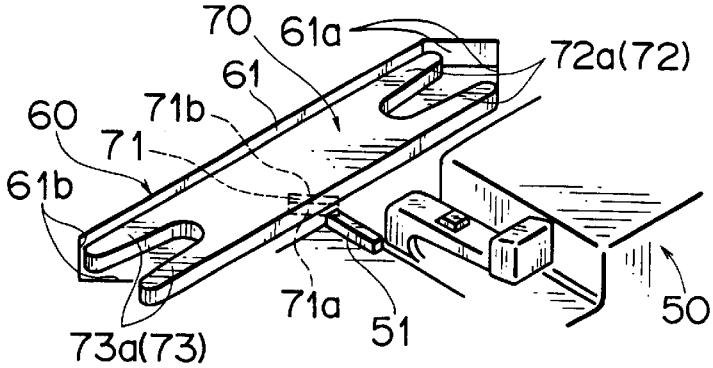
FIGS. 3A–3D are partial perspective views showing movement of a slider of a second embodiment of an electrical connector in accordance with the present invention.

In FIG. 3A, the electrical connector of the present embodiment consists of the male connector 50, the female connector 60, and the slider 70.

The male connector 50 is projectingly provided with a rib 51 on the top wall thereof.

On the other hand, the female connector 60 is provided with a slider receiving portion 61 the top wall thereof to slidably receive the slider 70 therein. On both sides of the slider receiving portion 61 first and second abutting planes 61*a*,61*b* are formed.

In the middle of the back of the slider 70, an oblique cam projection 71, on which the rib 51 of the male connector 50 abuts, projects.

And, a first spring portion 72 consisting of a pair of spring pieces 72*a*,72*a* and also a second spring portion 73 consisting of a pair of spring pieces 73*a*,73*a* are formed on both sides of the slider 70 integrally therewith.

Next, movement of the slider 70 is explained.

Figure 3B:
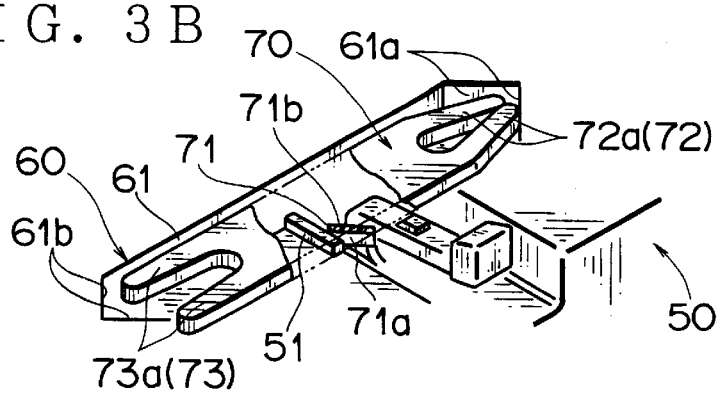

As is shown in FIGS. 3A, 3B, in a process of coupling the male connector 50 to the female connector 60, the rib 51 of the male connector 50 abuts against a first side plane 71*a* of the cam projection 71 of the slider 70 and makes the slider 70 slide toward the first abutting plane 61*a* side of the slider receiving portion 61.

This makes the first spring portion 72 of the slider 70 abut on the first abutting planes 61*a* and compressively transform, that is, the spring pieces 72*a* of the first spring portion 72 change from the open state to the closed state.

Figure 3C:
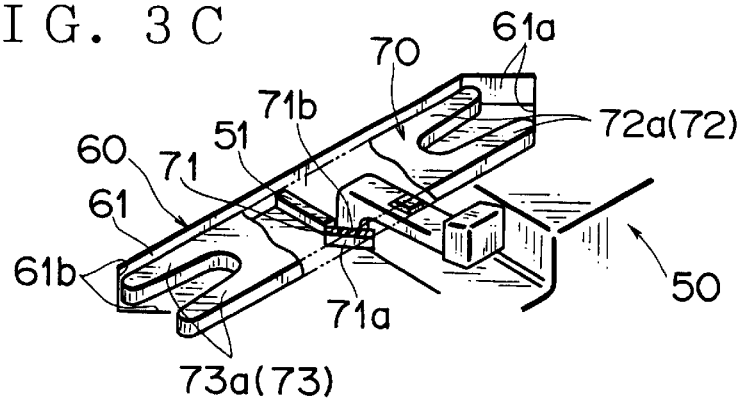

Following the above, as is shown in FIG. 3C, when the male connector 50 has completely coupled to the female connector 60, the rib 51 of the male connector 50 has passed over the first side plane 71*a* of the cam projection 71 of the slider 70.

By this, the first spring portion 72 returns and makes the slider 70 return to the initial state.

Figure 3D:
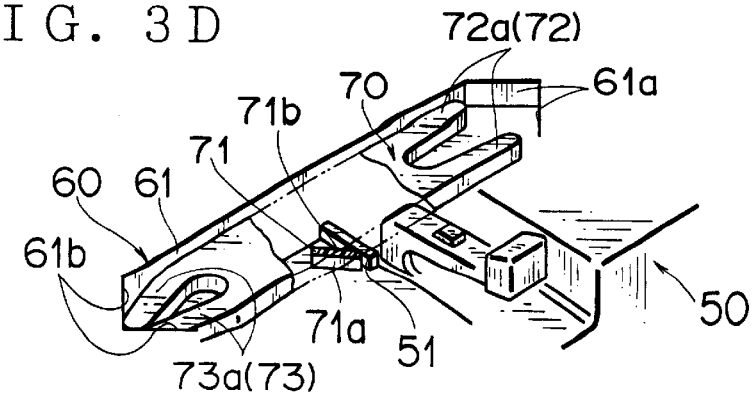
Figure 4:
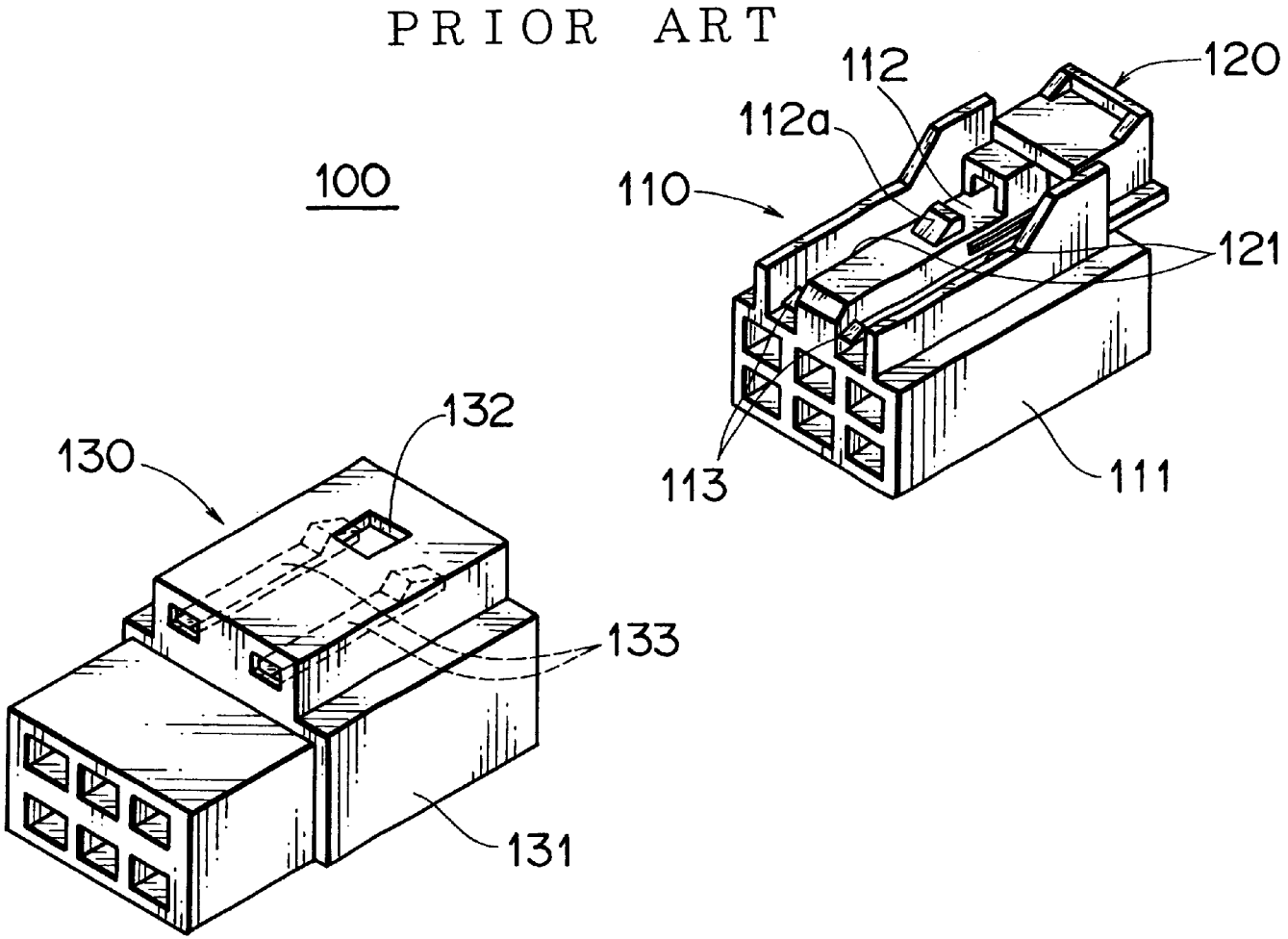
FIG. 4 PRIOR ART
FIG. 4 is a perspective view showing a first prior art electrical connectors consisting of male and female connectors.
Figure 5A:
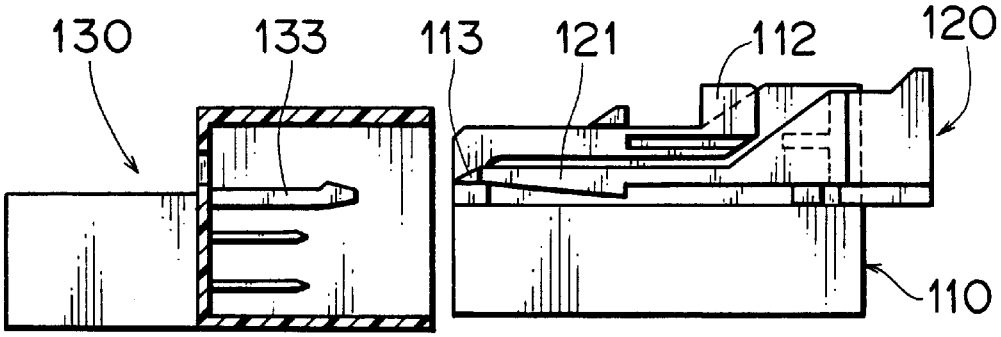
FIG. 5A PRIOR ART
FIGS. 5A–5C are partly sectional side views showing movement of a slider of the electrical connector of FIG. 4.
Figure 5B:
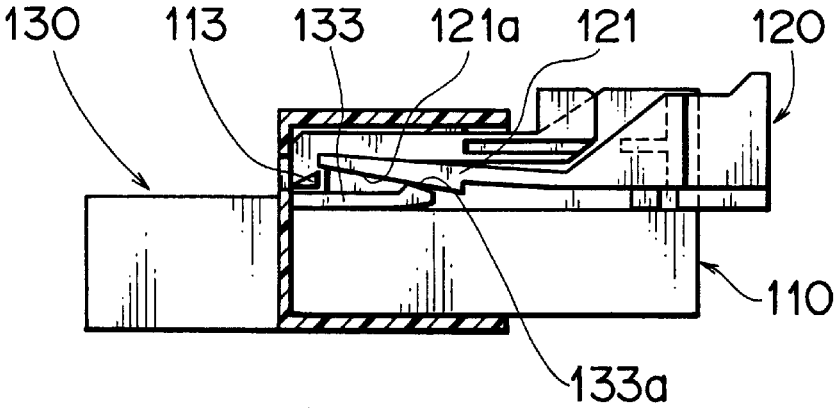
FIG. 5B PRIOR ART
Figure 5C:
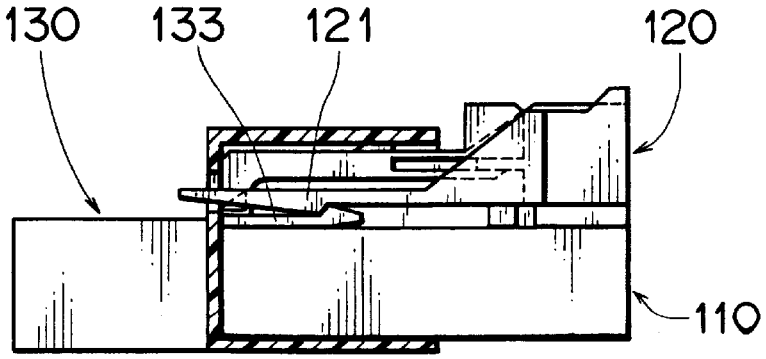
FIG. 5C PRIOR ART
Figure 6:
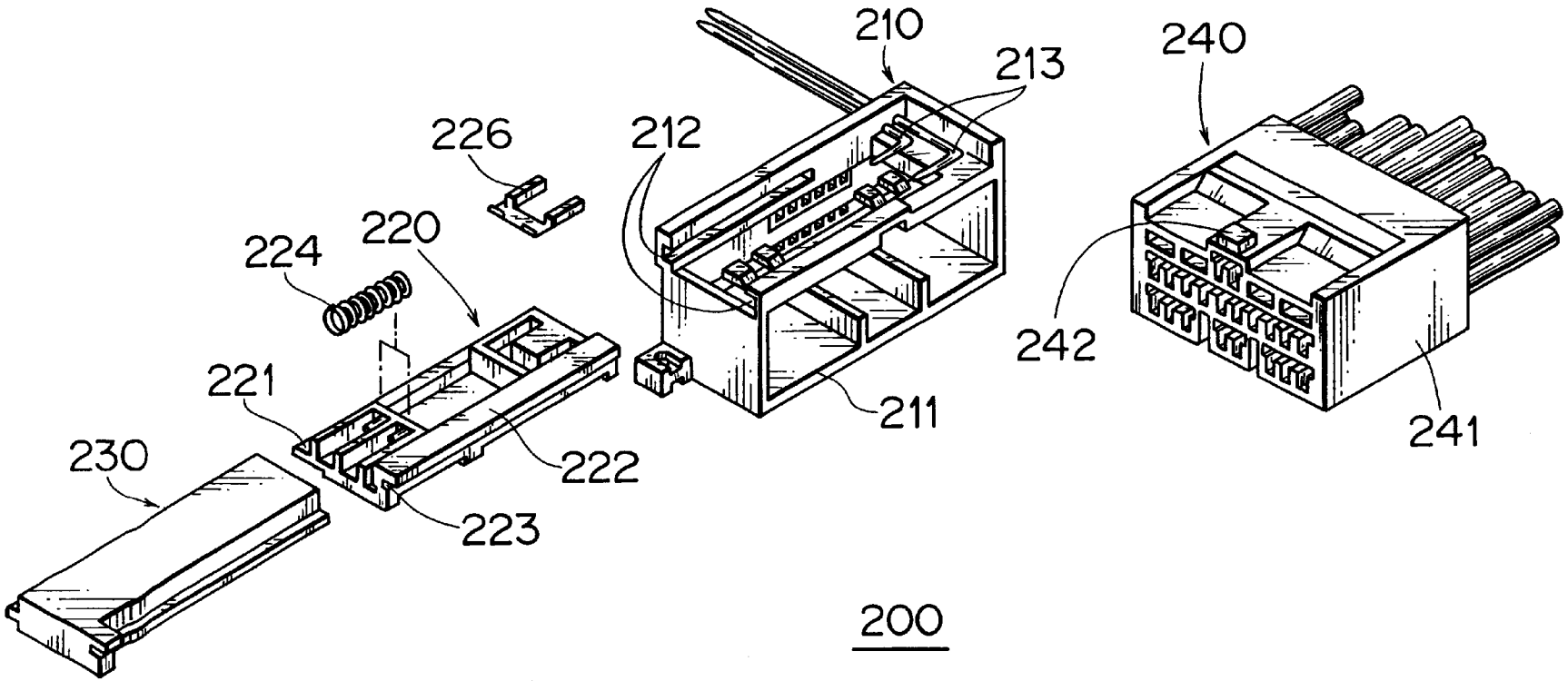
FIG. 6 PRIOR ART
FIG. 6 is an exploded perspective view showing a second prior art electrical connector consisting of male and female connectors.
Figure 7:
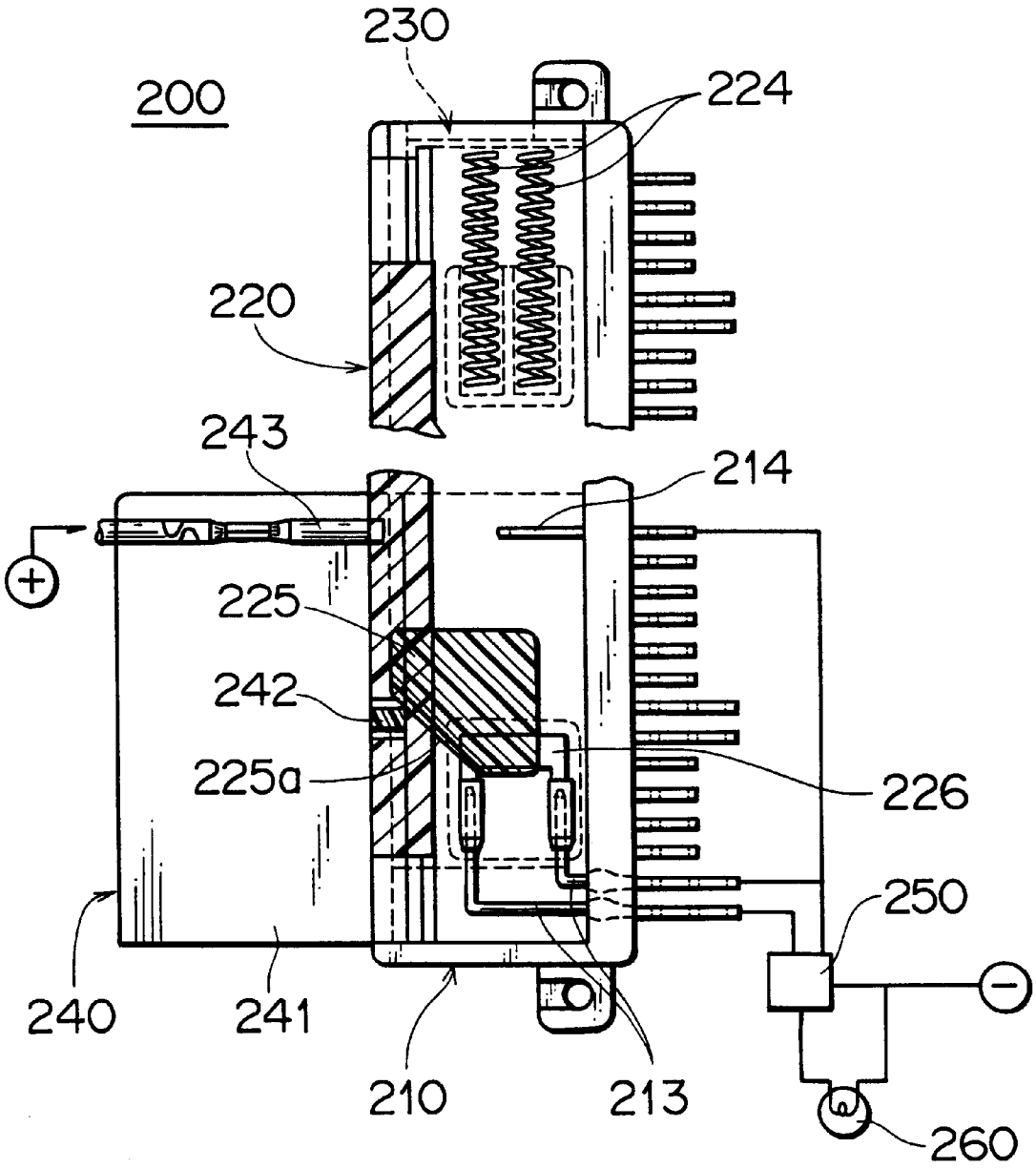
FIG. 7 PRIOR ART
FIG. 7 is a partly sectional plan view showing an initial coupling state of the male and female connectors of FIG. 6.

On the other hand, as is shown in FIG. 3D, in a process of uncoupling the male connector 50 from the female connector 60, the rib 51 of the male connector 50 abuts against a second side plane 71*b* of the cam projection 71 of the slider 70 and makes the slider 70 slide toward the second abutting planes 61*b* side of the slider receiving portion 61.

This makes the second spring portion 73 of the slider 70 abut on the second abutting planes 61*b* and compressively transform, that is, the spring pieces 73*a* of the second spring portion 73 change from the open state to the closed state.

Following the above, when the male connector 60 has been completely uncoupled from the female connector 50, the rib 51 of the male connector 50 has passed over the second side plane 71*b* of the cam projection 71 of the slider 70.

By this, the second spring portion 73 returns and makes the slider 70 return to the initial state.

According to the present embodiment of an electrical connector, an operator can look at and easily check a coupling state of the male and female connectors 50,60 according to a state of the first spring portion 72 being compressively transformed or not, without operating the slider 30 at all.

And, since the slider 70 automatically returns to the initial state when the male connector 50 has completely coupled to the female connector 60 and also has been completely uncoupled from the female connector 60, an operator can couple and uncouple the male and female connectors 50,60 without operating the slider 30 at all.

The spring portion to be formed on the slider may be in another shape which enables an operator to easily recognize change of its outline and simultaneously has resilience to return the slider to the initial state.

Although the present invention has been fully described by way of examples with reference to the accompanying drawings, it, is to be noted that various changes and modifications will be apparent to those skilled in the art. Therefore, unless otherwise such changes and modifications depart from the scope of the present invention, they should be construed as being included therein.

What is claimed is:

1. An electrical connector with a coupling state indicating mechanism, comprising:

a first connector having a semicylindrical projection having a curved surface and a plane surface;

a second connector having a slider receiving portion and to be coupled with said first connector, said slider receiving portion being provided with a guide groove having an engaging wall to guide said semicylindrical projection, and with an abutting plane; and a slider to be slidably received in said slider receiving portion for indicating a coupling state of said first and second connectors, said slider integrally having an engaging projection to prevent coming-off thereof by engaging the engaging wall of said slider receiving portion, an oblique cam groove to receive said semicylindrical projection therein and oblique in a direction to slide said slider toward said abutting plane, a releasing groove having a closed end and continuing from said cam groove in parallel with a longitudinal axis of said slider to release said semicylindrical projection from said cam groove when said first and second connectors have completely coupled so as to return said slider to an initial position, and a spring portion to abut on said abutting plane and to be compressively transformed to bring about a force to return said slider, wherein said curved surface of said semicylindrical projection slides on a wall of said cam groove so as to slide said slider toward said abutting plane and said plane surface of said semicylindrical projection is parallel to said releasing groove so as to surely shift said semicylindrical projection from said cam groove to said releasing groove, wherein said slider is moved and abuts on said abutting plane in a process of coupling said first and second connectors and then returns to said initial position upon complete coupling thereof, and said releasing groove of said slider engages said semicylindrical projection when said second connector.

2. The electrical connector according to claim 1, wherein a pair of planes is provided in abutting relationship with each being directed to a longitudinal axis of said sliding receiving portion, and said spring portion of said slider consists of a pair of spring pieces formed in a forked shape.

* * * * *